US011178916B2

(12) United States Patent
Moudrakis et al.

(10) Patent No.: US 11,178,916 B2
(45) Date of Patent: Nov. 23, 2021

(54) BABY SLEEP SACK

(71) Applicants: Themistoklis Moudrakis, Somerset, NJ (US); Eleftheria Moudrakis, Somerset, NJ (US)

(72) Inventors: Themistoklis Moudrakis, Somerset, NJ (US); Eleftheria Moudrakis, Somerset, NJ (US)

( * ) Notice: Subject to any disclaimer, the term of this patent is extended or adjusted under 35 U.S.C. 154(b) by 0 days.

(21) Appl. No.: 16/911,649

(22) Filed: Jun. 25, 2020

(65) Prior Publication Data

US 2021/0007417 A1 Jan. 14, 2021

Related U.S. Application Data

(60) Provisional application No. 62/872,200, filed on Jul. 9, 2019.

(51) Int. Cl.
*A41B 13/06* (2006.01)
*A47D 15/00* (2006.01)

(52) U.S. Cl.
CPC ..... *A41B 13/06* (2013.01); *A47D 15/008* (2013.01)

(58) Field of Classification Search
CPC ..... A61B 13/06; A47D 15/008
See application file for complete search history.

(56) References Cited

U.S. PATENT DOCUMENTS 2,536,363 A 1/1951 Godbout
4,451,932 A 6/1984 Wagemann et al.
5,713,373 A * 2/1998 Argentino ..... A61F 5/37 128/869
2003/0154549 A1 8/2003 Landry
2012/0174321 A1 7/2012 Haye
2014/0165257 A1* 6/2014 Wynh ..... A41B 13/06 2/69.5
2015/0182043 A1* 7/2015 Vickerman ..... A61F 5/3784 5/494
2015/0359355 A1* 12/2015 Rushing ..... A47D 5/00 5/655

FOREIGN PATENT DOCUMENTS

FR 3000892 A1 7/2014
JP 2003052496 A 2/2003

* cited by examiner

*Primary Examiner* — Fredrick C Conley
(74) *Attorney, Agent, or Firm* — Tatonetti IP

(57) ABSTRACT

A baby sleep sack that effectively secures an infant in a safe position on their bed is implemented to prevent the baby from sleeping on his side or stomach and encourage the baby to sleep on his back, thereby decreasing the chances of suffocation and SIDS (sudden infant death syndrome) while sleeping. The sleep sack, which may be comprised of cotton and/or other cloth material, has openings at the waist from which straps having respective connectors extend. The openings may be slits in the sleep sack's fabric through which the flat straps are able to extend. The sleep sack's straps may be attached to the sleep sack by stitching against the interior surface of the sleep sack. In typical implementations, the connectors may be positioned at the end of the respective straps and mate with corresponding connectors on an external strap to encourage safe-sleeping habits.

9 Claims, 5 Drawing Sheets

BABY SLEEP SACK

CROSS-REFERENCE TO RELATED APPLICATIONS

This non-provisional utility patent application claims the benefit of and priority to Provisional Application Ser. No. 62/872,200, entitled "Baby Sleep Sack and System," filed Jul. 9, 2019, the entire contents of which is hereby incorporated herein by reference.

BACKGROUND

Pediatricians and other medical professionals have recognized that babies should be placed on their back when lying in bed to prevent accidental suffocation. Studies also show that sudden infant death syndrome (SIDS) is more likely to occur when a baby sleeps on their stomach because the baby is breathing in their own carbon monoxide.

SUMMARY

A baby sleep sack that effectively secures an infant to their bed is implemented to prevent the baby from sleeping on his side or stomach and encourage the baby to sleep on his back, thereby decreasing the chances of suffocation and SIDS while sleeping. The sleep sack, which may be comprised of cotton and/or other cloth material, has openings at the waist from which straps having respective connectors, such as a male plug or female receptacle, extend. The openings may be slits in the sleep sack's fabric through which the flat straps are able to extend. The sleep sack's straps may be attached to the sleep sack by stitching against the interior surface of the sleep sack. In typical implementations, the connectors may be positioned at the end of the respective straps.

Bed straps may be attached to the bed or some portion of the crib (e.g., the frame) and be configured with corresponding connectors that mate with the sleep sack's connectors. The bed straps may be secured to the bed using some fastening mechanism, such as a bracket with screws, an adhesive, etc. While the strap can be attached to the bed, it does not have to be, rather, the straps can wrap around the bed and utilize a buckle to enable tightening and loosening of the strap so that the baby can have room to wiggle and move. While plugs and receptacles are described herein, other connecting mechanisms are also possible, such as friction fit, tab and notch, and the like. A user can connect the connectors when the baby is in the sleep sack and ready for sleep. The sleep sack will grow with the baby. For example, the sleep sack can be replaced with one of a larger size, but still use the same strap and clips from the original sleep sack, thereby making the present sleep sack system a cost-effective and convenient solution.

A cover may extend over and be movable on the straps so that the user can position the cover over the otherwise exposed connectors, which are typically comprised of some metal, plastic, or other durable material, and prevent the connectors from touching and causing discomfort to the baby. When the sleep sack is not in use, the bed's straps may neatly attach to each so that the straps do not lay on the surrounding floor.

DETAILED DESCRIPTION

Figure 1:
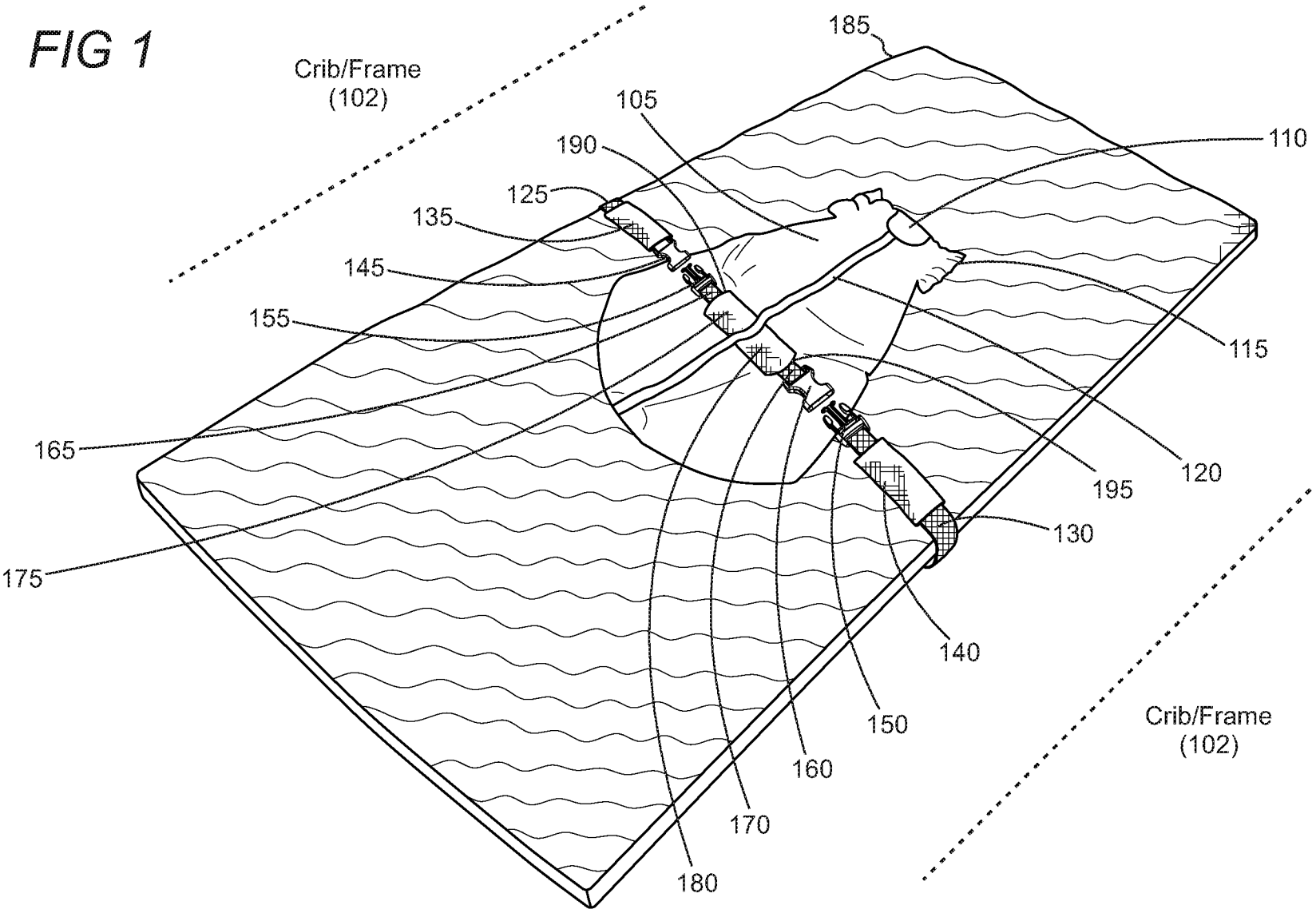
FIGS. 1 and 2 show illustrative representations of a sleep sack lying on a mattress.

FIG. 1 shows an illustrative representation in which the sleep sack system comes equipped with various straps to secure a baby in a safe position on a mattress 185 within a crib or bed frame 102. The sleep sack 105 comes with arm openings 115 and a head opening 110 through which the baby can extend his arms and head, respectively. The sleep sack may be comprised of cotton, polyester, spandex material, or any hybrid thereof or other types of materials which could be used with the current sleep sack system.

Figure 2:
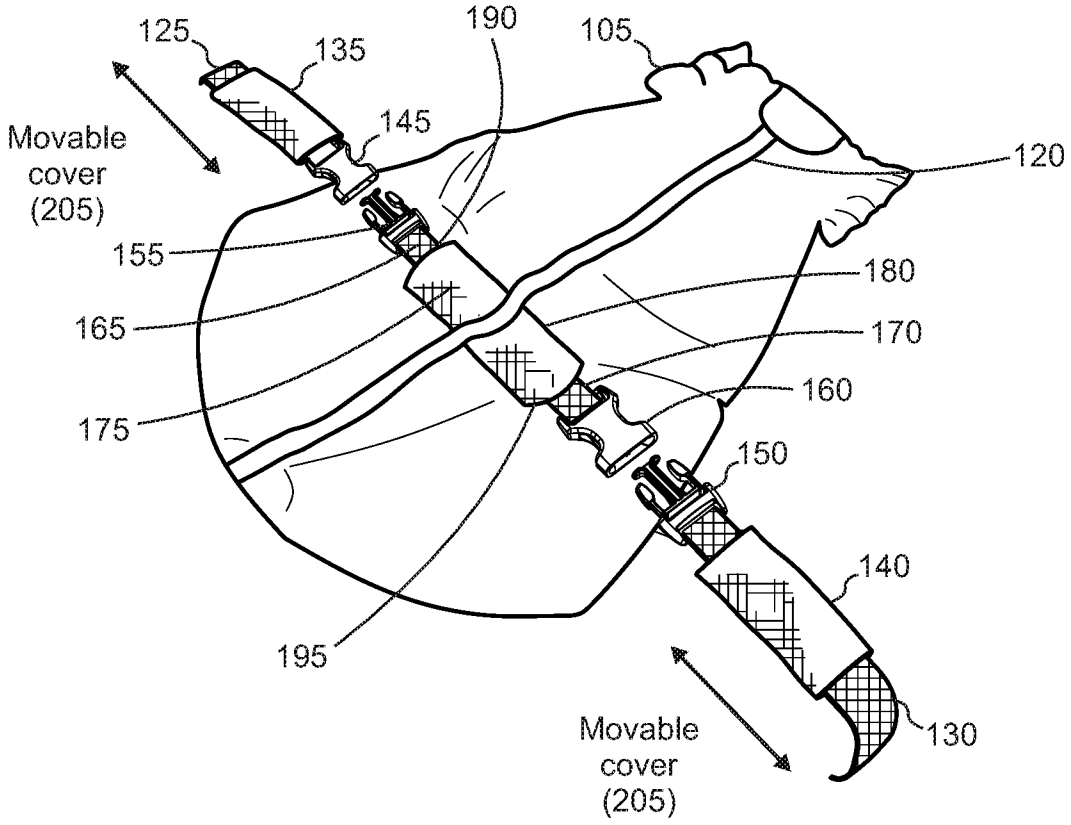

With reference to FIGS. 1 and 2, the sleep sack 105 includes right side strap 165 and left side strap 170 which extend from a respective right side opening 190 and left side opening 195. As illustrated by the characterization of the straps and openings, discussion of the sleep sack will be from the perspective of a wearer of the sleep sack. The openings are symmetrically positioned on laterally opposite sides of the center line 120 of the sleep sack. The center line may be, for example, where a zipper or other closing mechanism for the sleep sack is placed. The openings are, in typical implementations, slits in at least the outer fabric of the sleep sack. The portions of the right and left side straps 165, 170 are positioned within an interior of the sleep sack fabric. Furthermore, additional layers, the right support layer 175 and left support layer 180, are located adjacent to the straps and over the sleep sack system to provide additional support for the straps. These additional support layers 175, 180 may help prevent the sleep sack from tearing in the future due to usage of the straps and wear and tear on the sleep sack.

In typical implementations, the right and left side straps 165, 170 are a single strap which laterally extends from one symmetrical side of the sleep sack to the other, such as over the center line 120 of the sleep sack 105. The entire strap may be attached or fastened to the interior of the sleep sack fabric via adhesive, stitching, etc. In other implementations, the strap may be free for removal to enable a user to switch or change straps. In this regard, the right and left support layers 175, 180 and openings 190, 195 may be adapted to be a certain length to prevent the right and left connectors 155, 160 from easily entering and getting lost inside the interior of the sleep sack. For example, the support layers and openings may be shorter than the connectors.

In an implementation in which the right strap 165 and left strap 170 are formed of the same single strap, a right male plug 155 extends from the right side of the sleep sack and a left female receptacle extends from the left side. The distinct straps may be fastened to respective sides of the sleep sack in which neither strap extends beyond a center line 120 of the sleep sack. It may be understood that any plug or receptacle may be utilized and positioned on either end and at any location, and the drawings are exemplary of one particular embodiment for discussion purposes. The term "connector" may be utilized to characterize any connector piece, including a receptacle, plug, press-fit, or any type of connector. The right connector and left receptacle may be utilized to connect to an external strap to help maintain a safe sleeping position for a baby in the sleep sack.

External connecting mechanisms may include a right female receptacle 145 and a left male plug 150, which may respectively be used to connect and mate with the right male plug 155 and left female receptacle 160. The right and left connecting mechanisms extend from a right side strap 125 and left side strap 130 of one or more external straps. For example, in the implementation shown herein a single external strap is utilized and extends around a bottom of the mattress 185 and has a right side 125 and left side 130 that connect to the sleep sack's connectors. In other implementations, two external straps may be utilized, in which one each external strap connects to either the right or left side connectors 155, 160.

The sleep sack 105 includes a right cover 135 and a left cover 140 which wraps around the respective sides of the strap. If two external straps were used, then the at least one cover would be placed around each external strap. In FIGS. 1 and 2, the respective covers are positioned on the right and left side external straps 125, 130, however, the covers could also be kept over the right and left straps 165, 170, in some implementations. The covers may be comprised of a cotton material and may be thicker relative to the sleep sack's material as the cover's purpose is to provide a barrier to the baby from the connectors. Specifically, the covers are each moveable about the straps, as representatively shown by numerals 205, so that the covers can overlap with the connectors to prevent the baby from feeling any discomfort during sleep.

Figure 3:
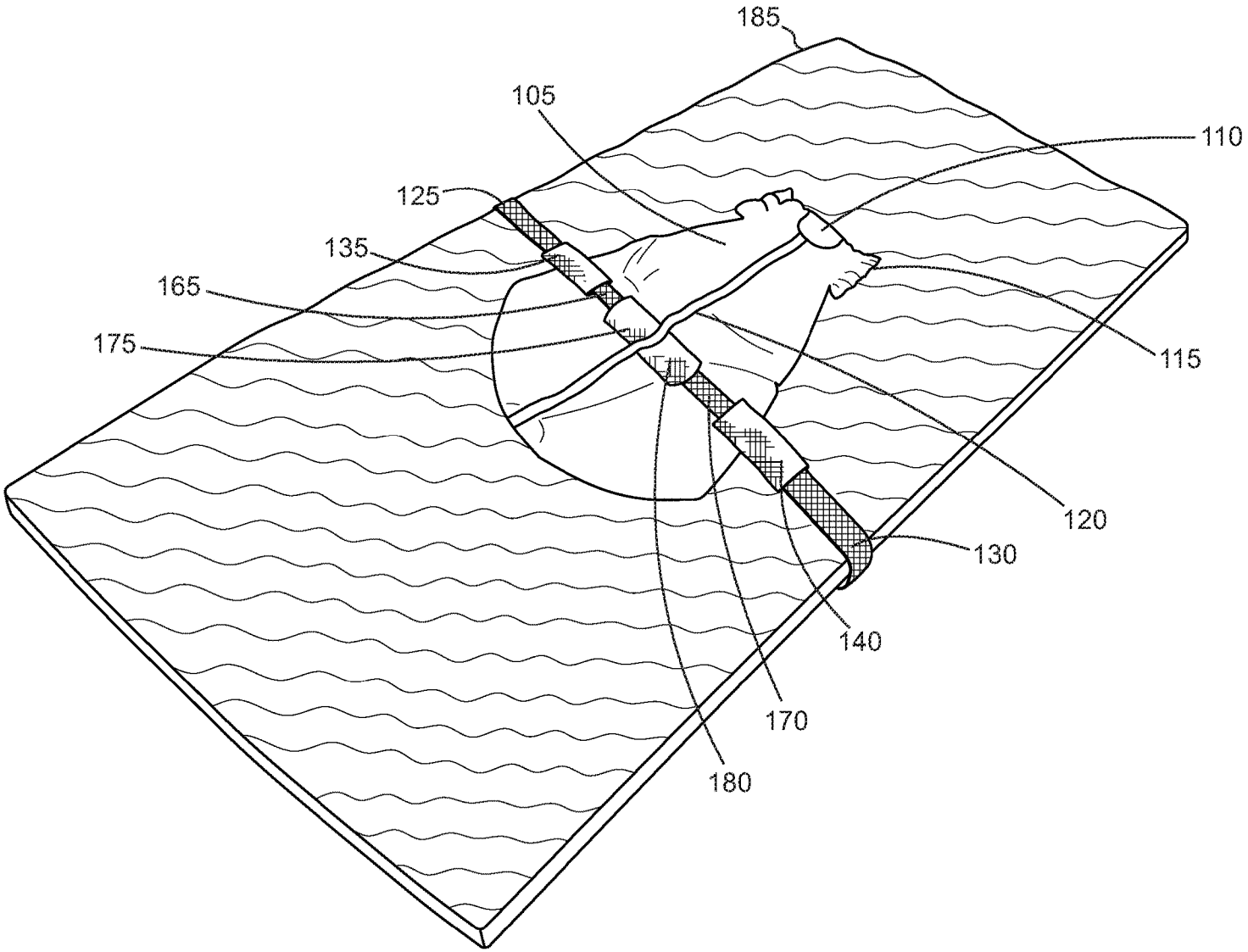
FIG. 3 shows an illustrative representation of the sleep sack having connectors with a movable cover over each set of straps.

FIG. 3 shows an illustrative representation in which the right and left covers 135, 140 have been moved over the mated connectors, namely right male plug 155 with right female receptacle 145, and left female receptacle 160 and left male plug 150. Thus, in use, the cover provides additional support and comfort by preventing the plastic or metallic connectors from resting against the baby.

Figure 4:
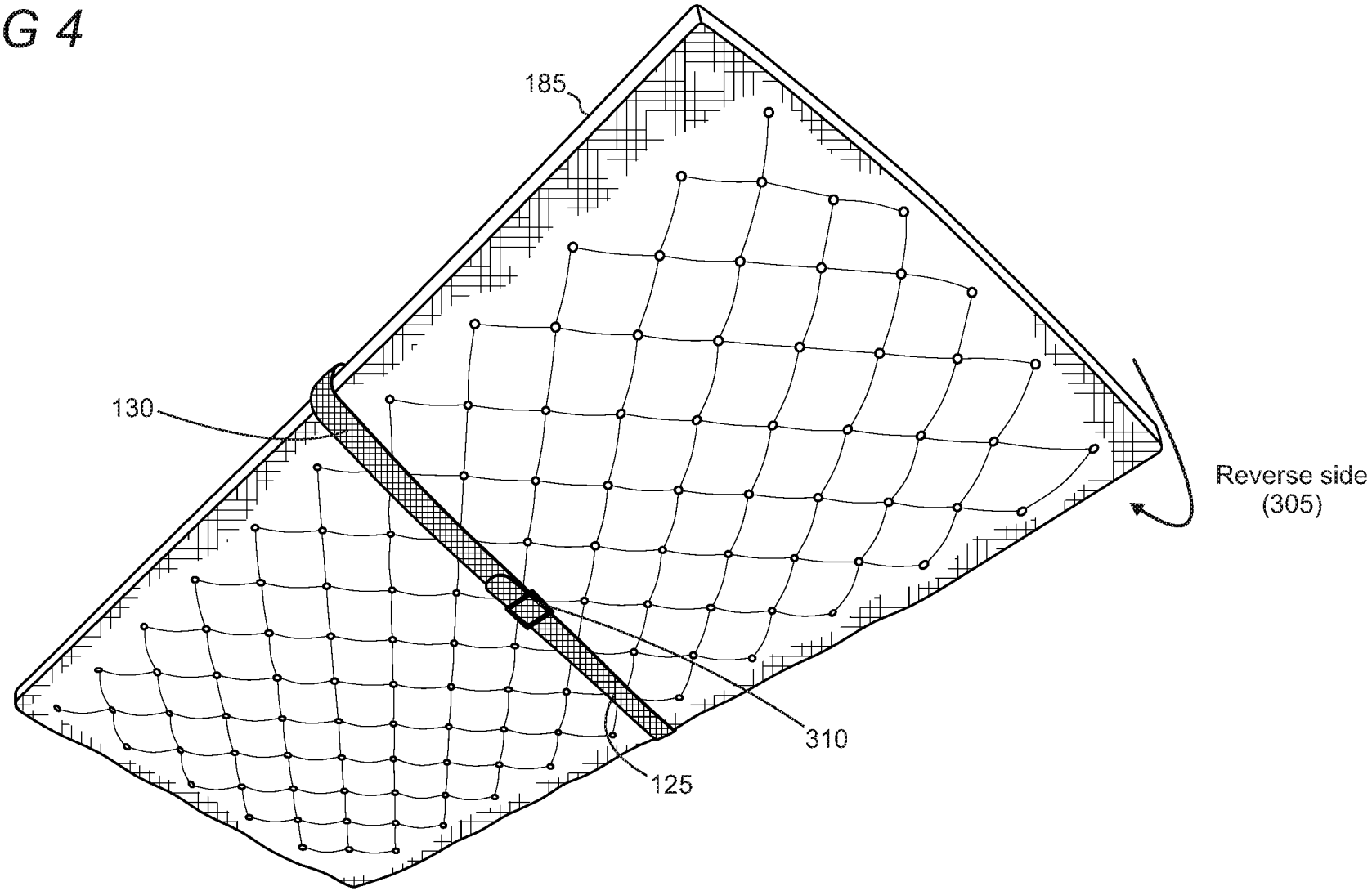
FIG. 4 shows an illustrative representation of the strap on a reverse side of the mattress.

FIG. 4 shows an illustrative representation in which a rear side 305 of the mattress 185 includes an adjusting mechanism, such as a buckle 310, which can be used to adjust the tightening or loosening of the external strap. The right and left sides 125, 130 of the external strap are shown for clarity. As discussed above, in other implementations different straps for the right and left sides may be utilized.

Figure 5:
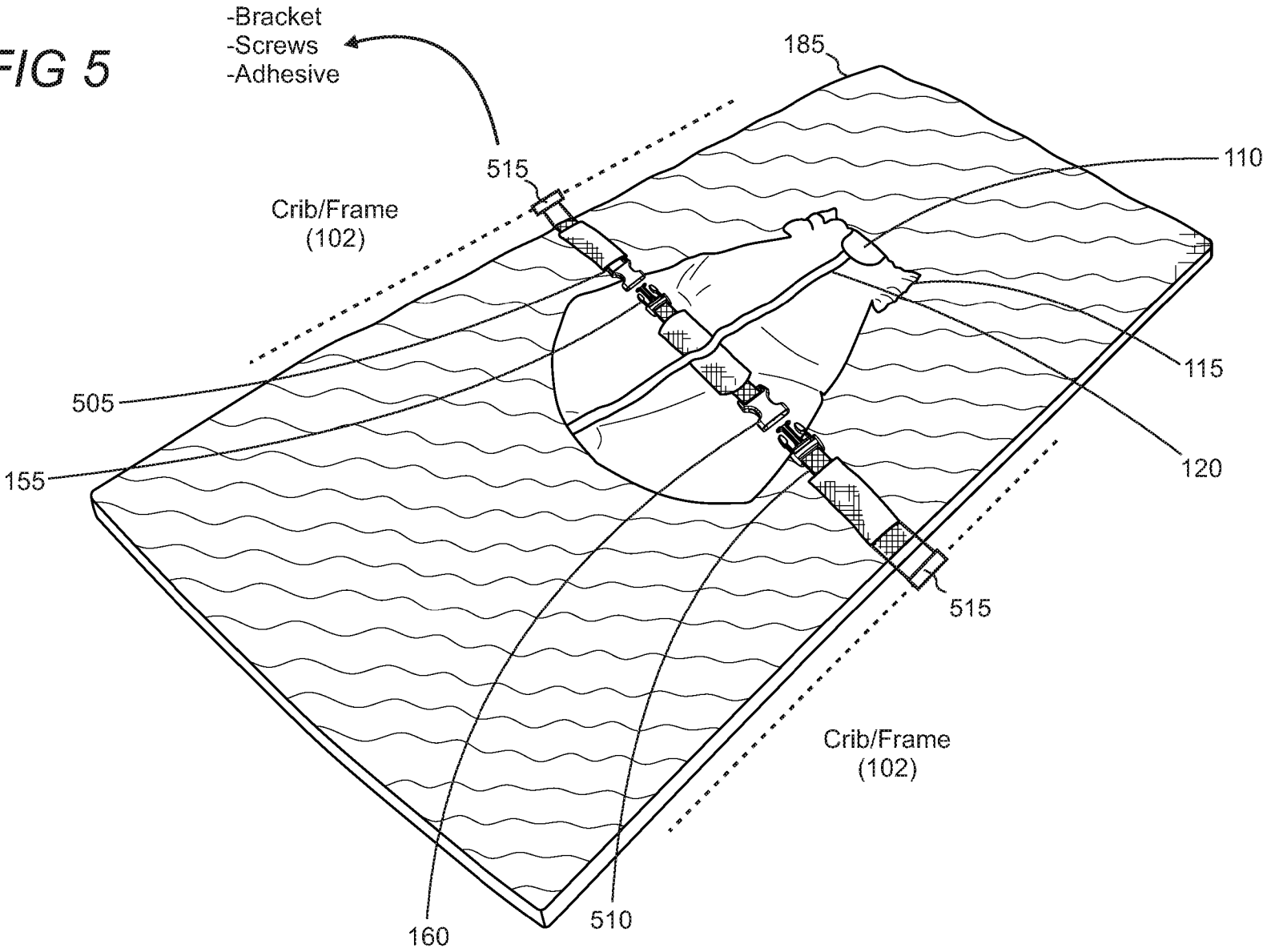
FIG. 5 shows an illustrative representation of the straps connecting to an external structure using an alternative mechanism.

FIG. 5 shows an illustrative representation in which two different external straps are utilized, right external strap 505 and left external strap 510. The external straps can respectively connect to the right male plug 155 and left female receptacle 160. The external straps may be connected to some external structure, such as the crib or bed frame 102, an adjacent wall, or other structure. Attachment mechanisms 515 may be utilized to attach the external straps to the external structure, such as the crib. Exemplary attachment mechanisms can include a bracket, screws, adhesive, etc.

Various exemplary embodiments of the sleep sack described herein is now disclosed. In one embodiment is a baby sleep sack system, comprising: a sleep sack to be worn by a baby; a right side opening located on one side of the sleep sack; a left side opening located on an opposite side of the sleep sack; and a left side connector and a right side connector which extend laterally outward from the left and right side openings, respectively, wherein the left and right side connectors are respectively configured to connect to corresponding connectors which are attached to straps and the straps are secured to a structure.

As another example, the right and left side opening are symmetrically positioned on opposite lateral sides of the sleep sack. In another example, the structure includes any one or more of a mattress, a crib, a bed frame, or a wall. In another example, the baby sleep sack further comprising a movable cover positioned on the straps of the female receptacles, wherein the covers can cover the connectors when attached to enhance comfort for the baby during use of the sleep sack. As another example, the left and right side connectors are attached to straps which are attached to an interior of the sleep sack. In that example, the straps are attached to the interior of the sleep sack via stitching. As another example, the baby sleep sack further comprising a protective layer which extends from the left and right side opening to a central portion of the sleep sack to provide greater comfort to the baby. As another example, the left and right side connectors and the corresponding connectors are either a male plug or a female receptacle. In another example, the left and right side connectors are attached to a same single strap which extends laterally across a center line on the sleep sack. As another example, the left and right side connectors are attached to distinct straps that are fastened to the sleep sack, in which each distinct strap does not extend beyond a center line of the sleep sack.

The invention claimed is:

1. A baby sleep sack system, comprising:

a sleep sack to be worn by a baby;

a front center opening extending from a center of a front of the sleep sack's neck;

a right side pocket from which a right side opening is positioned, in which a base of the right side pocket is located on a right side of the sleep sack and which engages a right side of the front center opening, wherein the right side opening is on a top surface of the sleep sack;

a left side pocket from which a left side opening is positioned, in which a base of the left side pocket is located on a left side of the sleep sack and which engages with the left side of the front center opening, wherein the left side opening is on the top surface of the sleep sack; and a left side strap and a right side strap extending outward from the left side opening and right side opening, respectively, wherein the left and right side openings are a distance from the bases of the left and right side pockets, respectively;

a left side connector and a right side connector respectively attached to ends of the left side strap and right side strap, wherein the left and right side connectors do not extend beyond an end of the sleep sack, wherein the left and right side connectors are respectively configured to connect to corresponding connectors which are attached to straps and the straps are secured to a structure.

2. The baby sleep sack system of claim 1, wherein the right and left side openings are symmetrically positioned on opposite lateral sides of the sleep sack.

3. The baby sleep sack system of claim 1, wherein the structure includes any one or more of a mattress, a crib, a bed frame, or a wall.

4. The baby sleep sack system of claim 1, further comprising a movable cover positioned on each of the left and right side straps of the left and right side connectors, respectively, wherein the covers cover the left and right connectors when attached to enhance comfort for the baby during use of the sleep sack.

5. The baby sleep sack system of claim 1, wherein the left and right side straps are attached to an interior of the sleep sack.

6. The baby sleep sack system of claim 5, wherein the left and right side straps are attached to the interior of the sleep sack via stitching.

7. The baby sleep sack system of claim 1, wherein the left and right side connectors are attached to distinct straps that are fastened to the sleep sack, in which each distinct strap does not extend beyond a center line of the sleep sack.

8. The baby sleep sack system of claim 1, wherein the left and right side connectors and the corresponding connectors are either a male plug or a female receptacle.

9. The baby sleep sack system of claim 1, wherein the left and right side connectors are attached to a same single strap which extends laterally across a center line on the sleep sack.

* * * * *